US006669023B2

(12) United States Patent
Kikuchi et al.

(10) Patent No.: US 6,669,023 B2
(45) Date of Patent: Dec. 30, 2003

(54) STORAGE CASE

(75) Inventors: Shuichi Kikuchi, Miyagi (JP); Rie Izu, Miyagi (JP)

(73) Assignee: Sony Corporation, Tokyo (JP)

( * ) Notice: Subject to any disclaimer, the term of this patent is extended or adjusted under 35 U.S.C. 154(b) by 102 days.

(21) Appl. No.: 09/940,346

(22) Filed: Aug. 27, 2001

(65) Prior Publication Data

US 2002/0033353 A1 Mar. 21, 2002

(30) Foreign Application Priority Data

Aug. 29, 2000 (JP) ..... P2000-258459

(51) Int. Cl.[7] ..... B65D 85/57

(52) U.S. Cl. ..... 206/759; 206/307; 220/815; 220/832

(58) Field of Search ..... 220/811, 812, 220/813, 815, 831, 832; 206/759, 307, 308.3

(56) References Cited

U.S. PATENT DOCUMENTS 391,145 A * 10/1888 Hardin ..... 229/125.11
RE30,890 E * 3/1982 Hodge ..... 220/331
4,759,443 A * 7/1988 Egly ..... 206/425
5,355,997 A * 10/1994 Kikuchi ..... 206/759
5,411,134 A * 5/1995 Temple et al. ..... 206/753
6,129,237 A * 10/2000 Miyahara ..... 425/193

* cited by examiner

*Primary Examiner*—Jacob K. Ackun
(74) *Attorney, Agent, or Firm*—Frommer Lawrence & Haug LLP; William S. Frommer; Matthew K. Ryan

(57) ABSTRACT

A storage case is comprised of a case main body, a cover, a rotating means and a tilt means. The case main body has a bottom plate, the front plate, a back plate, a right plate and a left plate which are arranged so that the front, back, right and left plates surround four sides of the bottom plate. The cover is installed to the case main body so as to open and close an opening of the case main body. The rotating means swingably and slidably connects the cover with the case main body. The rotating means has a rotation shaft installed to the cover and a bearing portion installed to the case main body. The bearing portion is formed into an elongate groove extending in a vertical direction of the case main body. The front plate is tilted forward by the tilt means.

15 Claims, 13 Drawing Sheets

STORAGE CASE

BACKGROUND OF THE INVENTION

The present invention relates to a storage case preferably employed for storing information-storage medium (hereinafter, it is called a disc) such as a magnetic disc and an optical disc.

FIGS. 19 and 20 show a known disc storage case 101 for storing a plurality of discs. This disc storage case 101 comprises a case main body 107, a cover 108 for opening and closing an opening of the case main body 107 and a rotating means 109 for rotatably installing the cover 108 to the case main body 107. The case main body 107 comprises a bottom plate 102, and front, back, right side and left side plates 103, 104, 105 and 106 which are provided at four sides of the bottom plate 102 so as to surround the bottom plate 102.

As shown in FIG. 21, the rotating means 109 comprises a rotation shaft 110 installed to the case main body 107 and a bearing portion installed to the cover 108. The rotation shaft 110 is formed into a cylindrical shape. The bearing portion 111 is also formed into a cylindrical shape which is larger in diameter than that of the rotation shaft 110. The cover 108 is arranged so as to be rotated from a closed condition by 180° and to be put in an open condition shown in FIG. 20.

However, this conventional storage case 101 has the following problems:

(1) When the cover 108 is put in the open condition, a gravity point of the storage case 101 is moved. This puts the storage case 101 into an unstable state that the storage case 101 tends to fall down. Further a width W1 of the storage case 101 in the cover open condition becomes twice the width W2 of the storage case in a cover closed condition (W1=2×W2), and therefore the storage case restricted in space.

(2) When a lot of discs 201 are stored in the case main body 107, it is difficult to pull out the disc 201 from the case main body 107, due to.

SUMMARY OF THE INVENTION

It is therefore an object of the present invention to provide a storage case which solves the above problems by arranging so as to be able to move a cover uprightly to a back of a case main body and to tilt a front plate of the case main body forward.

A storage case according to the present invention comprises a case main body, a cover and a rotating means. The case main body comprises a bottom plate, a front plate, a back plate, a right plate and a left plate, the front, back, right and left plates being arranged so as to surround four sides of the bottom plate, the case main body having an opening opposite to the bottom plate. The cover is installed to the case main body so as to open and close the opening of the case main body. The rotating means rotatably installs the cover to the case main body. The rotating means comprises a rotation shaft installed to the cover and a bearing portion installed to the case main body, the bearing portion being formed into a elongate groove extending in a vertical direction of the case main body.

DETAILED DESCRIPTION OF THE INVENTION

Figure 1:
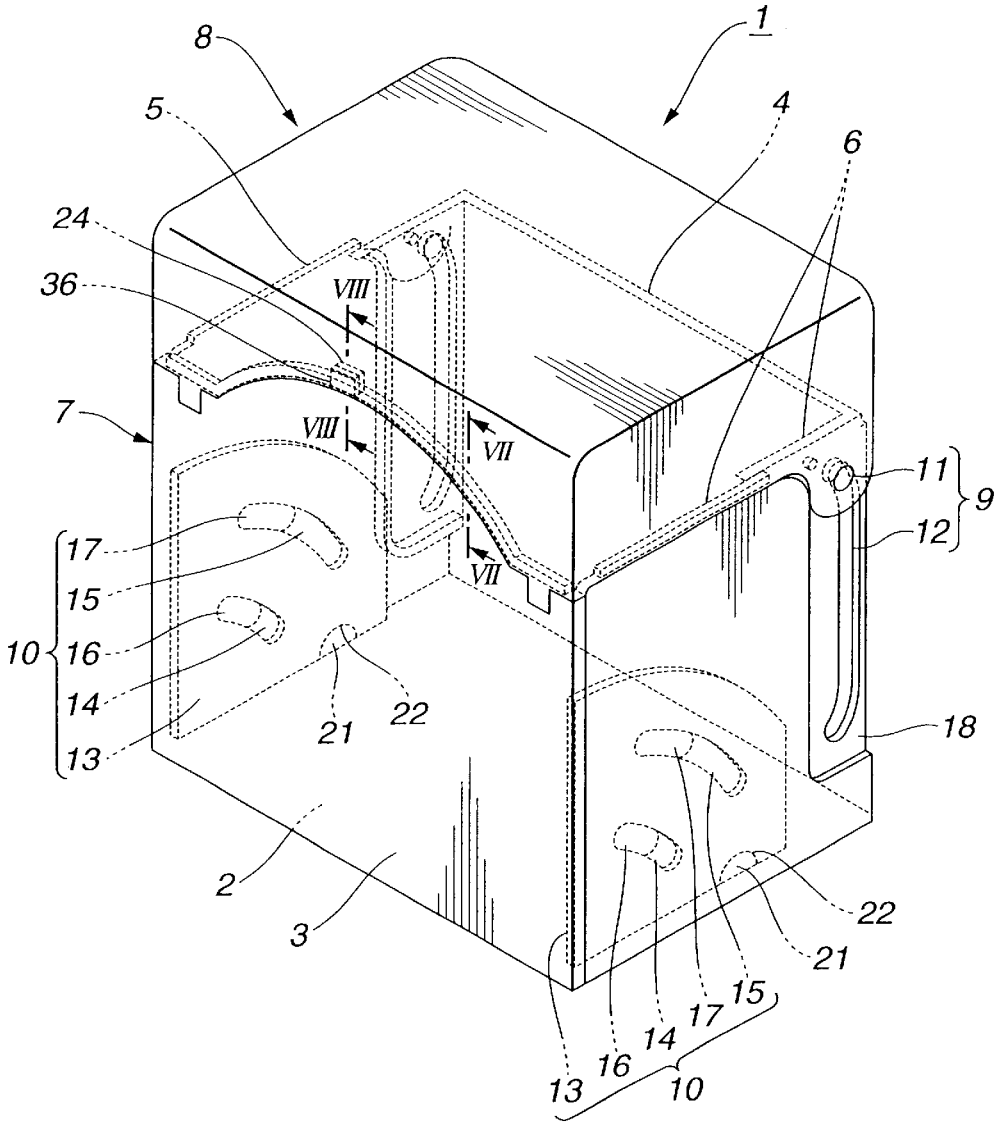
FIG. 1 is a perspective view showing an embodiment of a storage case according to the present invention.
Figure 2:
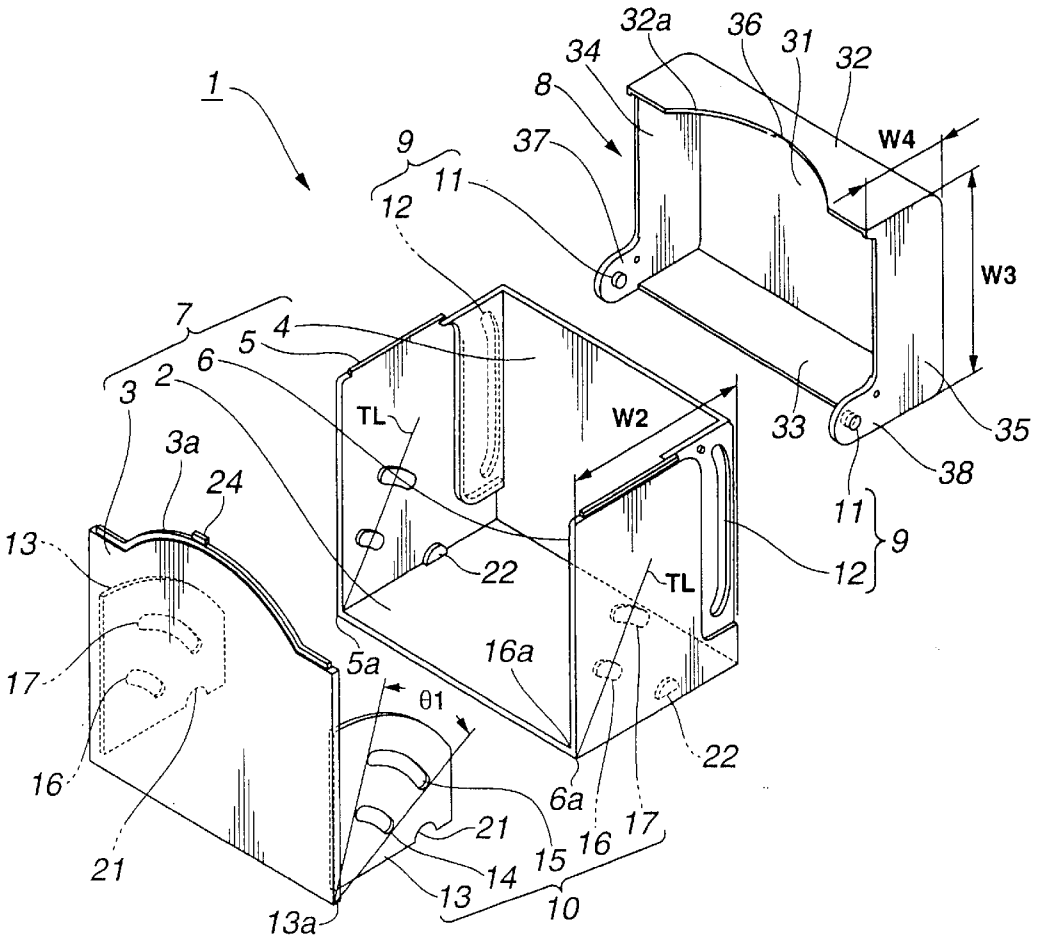
FIG. 2 is an exploded perspective view showing the storage case of FIG. 1.

FIG. 1 is a perspective view of a storage case 1 according to the present invention, and FIG. 2 is an exploded perspective view of the storage case 1. The storage case 1 comprises a case main body 7, a cover 8, a rotating means 9 and a tilting means 10. The case main body 7 comprises a bottom plate 2, and a front plate 3, a back plate 4, a right plate 5 and a left plate 6. The front, back, right and left plates 3, 4, 5 and 6 are installed to four sides of the bottom plate 2 so as to surround the bottom plate 2. The rotating means 9 is arranged to rotatably install (open and close) the cover 8 to the case main body 7. The tilting means 10 is arranged to tilt the front plate 3 in the front direction so as to extend the opening of the case main body 7.

The rotating means comprises a pair of rotation shafts 11 installed to the cover 8 and a pair of bearing portions 12 installed to the case main body 7. The bearing portions 12 are formed into elongate grooves so as to be able to move the rotation shafts 11 along the vertical direction.

The tilt means 10 comprises a pair of arm-like overlap plates 13 and 13, first and second tilt guide grooves 14 and 15, and first and second tilting shafts 16 and 17. The overlap plates 13 and 13 extend from both side peripheries of the front plate 3 to be perpendicular to the front plate 3 and along the right and left plates 5 and 6, respectively. The first and second tilt guide grooves 14 and 15 are formed on an outer surface of each of the arm-like overlap plates 13 and 13. The first and second tilting shafts 16 and 17 are formed on an inner surface of each of the right and left plates 5 and 6 and are engaged with the first and second tilt guide grooves 14 and 15, respectively.

The bottom plate 2, the back plate 4, the right and left plates 5 and 6 of the case main body 7 are made of thermoplastic resin such as ABS resin (acrylonitrile-butadiene-styrene resin), AS resin (acrylonitrile-styrene resin) and GPPS (GP polostylene), and are integrally molded by means of the injection molding. The front plate 3 is made of the same resin of a unit of the bottom plate 2, the back plate 4, the right and left plates 5 and 6 of the case body 7, and is molded as a piece separated from the unit.

The bearing portions 12 of elongate groove shapes are formed on depressed portions 18 provided on outer surfaces of the right and left plates 5 and 6, respectively. Each of the bearing portions 12 has a length corresponding to a width W3 of the cover 8 so that the cover 8 slides along the back plate 4 and is just set on the back plate 4 and that the cover 8 projects from the back plate 4 by a depth W4 of the cover 8.

Figure 3:
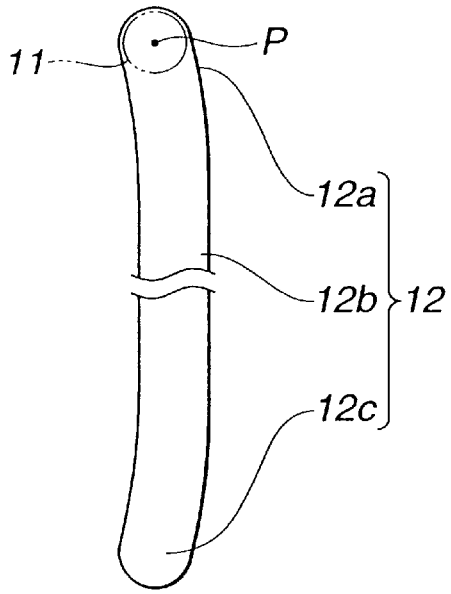
FIG. 3 is an enlarged front view showing a bearing portion of the storage case.

As shown in FIG. 3, Each of the bearing portions 12 is constituted by a first groove portion 12*a*, a second groove portion 12*b* continuous with the first groove portion 12*a*, and a third groove portion 12*c* continuous with the second groove portion 12*b*. When the cover 8 is put in a closed condition, each rotation shaft 11 integral with the cover member 8 is supported at the first groove portion 12*a*. When the cover 8 is opened and slid down or up along the back plate 4, the rotation shaft 11 is slid down and up along second groove portion 12*b* so that the cover 8 is slightly apart from the back plate 4 of the case main body 7. The third groove portion 12*c* is arranged such that the cover 8 approaches the case main body 7 when the cover 8 is moved down at the lower side of the case main body 7.

The first groove portion 12*a* is formed into an arc shape which starts from a center point P of the rotation shaft 11 under the cover closed condition to the backward, so that the rotation shafts 11 are prevented from slipping down along the bearing portions 12 when the cover 8 is just opened. This arrangement enables the cover 8 to be smoothly opened and closed. The second groove portion 12*b* is formed straight, and the third groove portion 12*c* is formed into an arc shape which is generally symmetrical to the arc shape of the first groove portion 12*a*.

As shown in FIG. 2, the overlap plates 13 and 13 including the tilt means 10 are integrally formed with the front plate 3 so that lower ends of the overlap plates 13 and 13 are generally aligned to the lower end of the front plate 3. The first and second tilt guide grooves 14 and 15 are formed into arc shapes, which are coaxial with each other and have an angle θ1 relative to a corner portion 13*a* of each of the overlap plates 13 and 13. The first and second tilt shafts 16 and 17 are formed on lines TL respectively including corners 5*a* and 6*a* of the right and left plates 5 and 6. The first and second tilt shafts 16 and 17 are engaged with the first and second tilt guide grooves 14 and 15 when the overlap plates 13 and 13 are overlappedly set inside the inner surfaces of the right and left plates 5 and 6.

Figure 4:
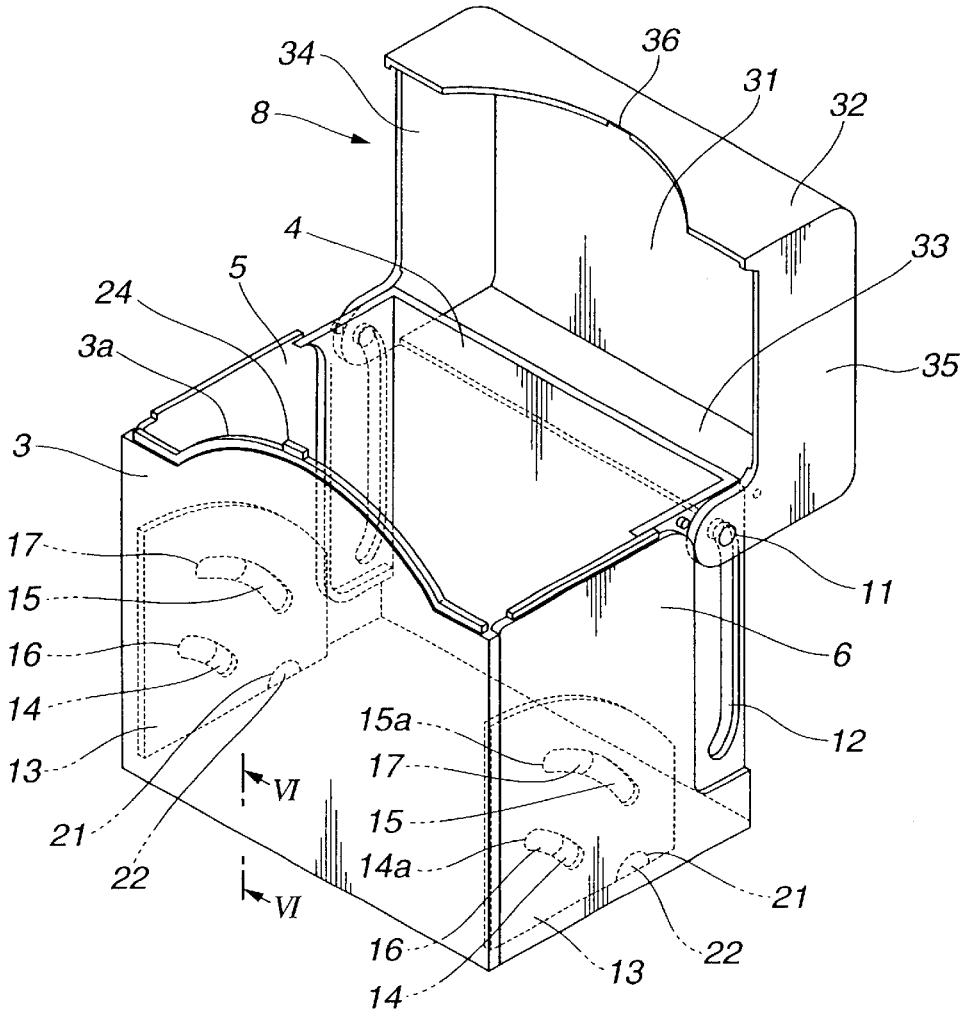
FIG. 4 is a perspective view showing the storage case in a condition that a front plate is set at an upright state.

As shown in FIG. 4, by setting the front plate 3 in an upright state (non-tilted state), end portions 14*a* and 15*a* of the first and second tilt guide grooves 14 and 15 are in contact with the first and second tilt shafts 16 and 17, respectively. This arrangement prevents the front plate 3 from tilting toward the back plate 4. Further, when the front plate 3 is tilted in the forward direction, the other end portions 14*b* and 15*b* of the first and second tilt grooves 14 and 15 are in contact with the first and second tilt shafts 16 and 17, respectively. This arrangement limits the swings of the first and second shafts 16 and 17 and allows the front plate 3 from being kept in the tilt state with a tilt angle θ2.

The first and second tilt shafts 16 and 17 are formed into arc shapes having the curvatures as same as those of the first and second tilt guide grooves 14 and 15, respectively. These arc-shaped arrangements of the first and second tilt shafts 16 and 17 enables the front plate 3 to be smoothly tilted without generating backlash. It will be understood that the shape of the first and second tilt shafts 16 and 17 are not limited to this arc-shape and may be formed into the other shape such as circular shape or elliptic shape.

As shown in FIG. 2, in order to fittingly set the front plate 3 at a correct upright position, a pair of depressed portions 21 and 21 are formed at lower surfaces of the overlap plates 13 and 13 respectively, and a pair of projecting portions 22 are formed at an upper surface of the bottom plate 2. Accordingly, when the front plate 3 is returned to the upright state (non-tilted state) from the tilted state, the depress portions 21 are engaged with the projecting portions 22 and therefore the front plate 3 is positioned at the correct upright position, as shown in FIG. 4.

Figure 6:
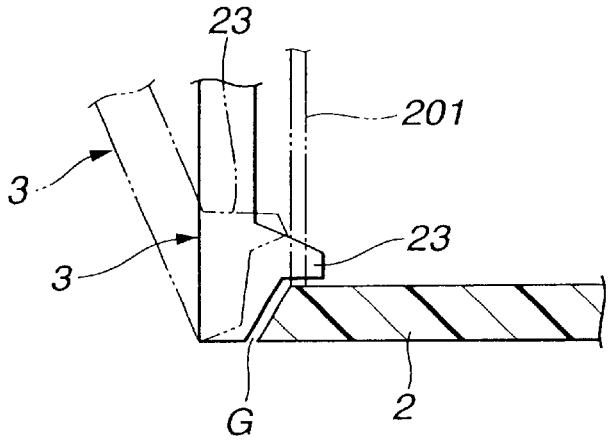
FIG. 6 is a cross sectional view taken in the direction of arrows substantially along the line VI—VI of FIG. 4.

As shown in FIG. 6, a rib 23 is provided at a lower and inner end portion of the front plate 3 so that the rib 23 covers a clearance G generated between the lower end of the front plate 3 and the bottom plate 2 when the front plate 3 is put in the tilted state. This arrangement prevents a lower end of a disc from sliding in the clearance G.

Figure 5:
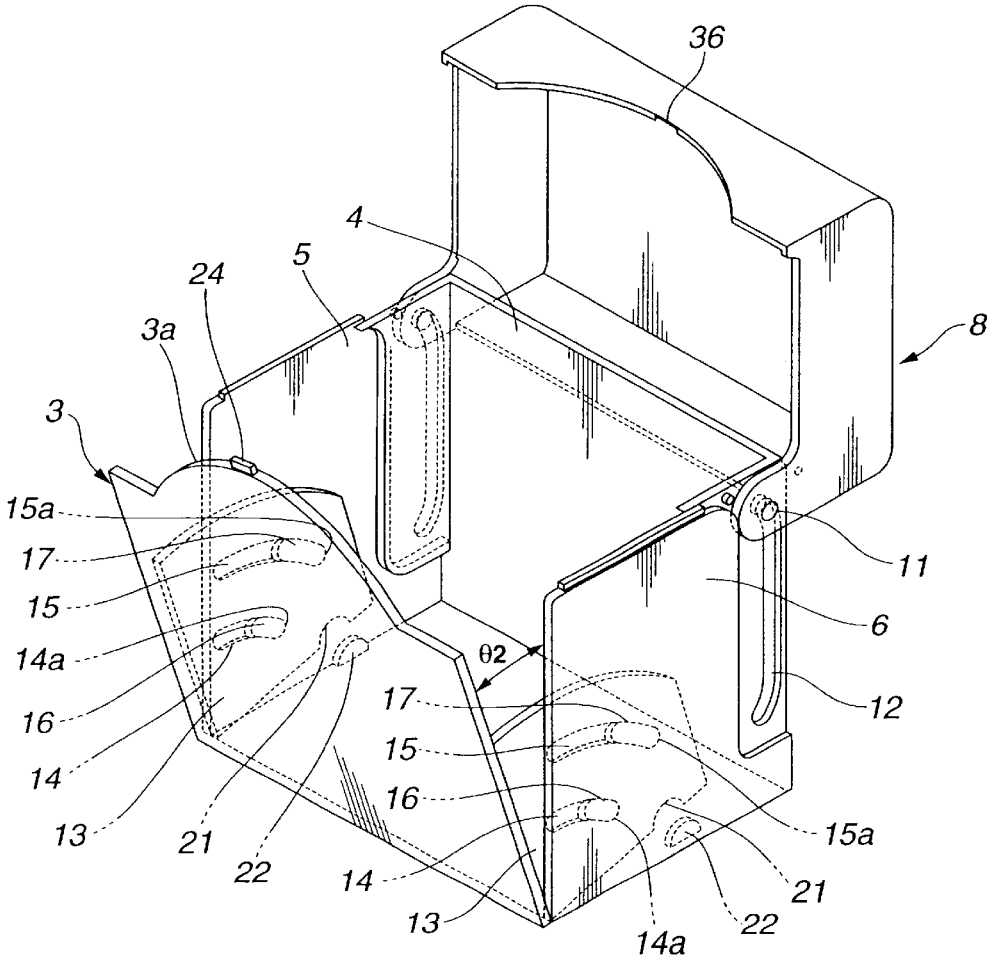
FIG. 5 is a perspective view showing the storage case in a condition that the front plate is set at a tilt state.
Figure 7:
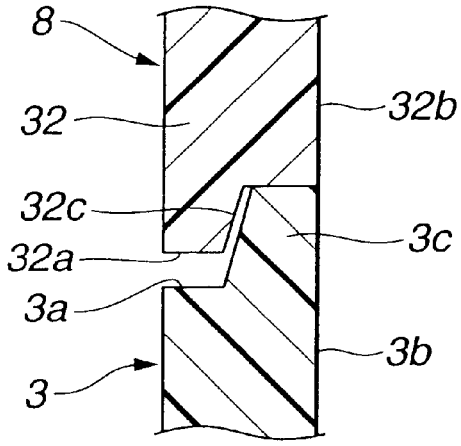
FIG. 7 is a cross sectional view taken in the direction of arrows substantially along the line VII—VII of FIG. 1.

As shown in FIG. 5, an upper periphery 3*a* of the front plate 3 is formed into a generally arc shape so as to be curved along an upper periphery of discs stored in the storage case 1. As shown in FIG. 7, a projecting portion 3*c* of a flange shape is formed at an inner surface 3*b* of the upper periphery 3*a* of the front plate 3, and a projecting portion 32*c* is formed at a front and lower periphery of the cover 8. Accordingly, when the cover 8 is put in the closed condition, the projecting portion 3*c* of the front plate 3 is engaged with the projecting portion 32*c* of the cover 8 so that the front plate 3 stays in the upright state.

Figure 8:
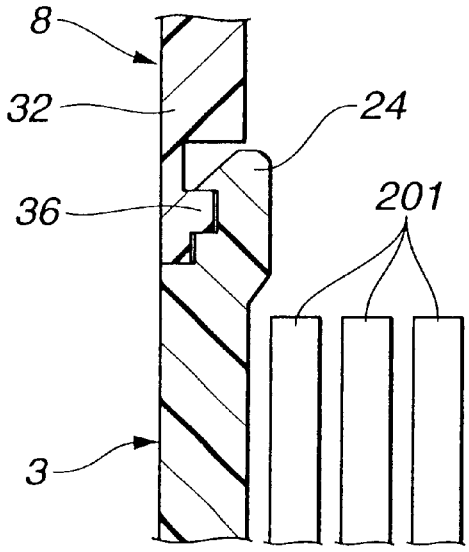
FIG. 8 is a cross sectional view taken in the direction of arrows substantially along the line VIII—VIII of FIG. 1.

As shown in FIG. 5, a cover lock portion 24 is formed at a center portion of the upper periphery 3*a* of the front plate 3 to lock the cover 8 in the closed condition. As shown in FIG. 8, the cover lock portion 24 is located at an upper position upper than the upper ends of discs stored in the storage case 1 so as not to injure the discs. When the cover 8 is put in the closed condition, a locked portion 36 of the cover 8 is engaged with the cover lock portion 24 of the front plate 3 to lock the cover 8 in the closed condition.

Next, there will be discussed the cover 8 in detail. As shown in FIG. 2, the cover 8 comprises an upper plate 31, a front plate 32, a back plate 33, a right plate 34 and a left plate 35. The upper plate 32 has a size generally the same as that of the bottom plate 3 of the case main body 7. The front, back, right and left plates 32, 33, 34 and 35 are arranged to surround the four sides of the upper plate 31. The cover 8 is made of transparent or semi-transparent thermoplastic resin such as ABS resin, AS resin and GPPS, and the respective elements of the cover 8 are integrally molded by means of the injection molding.

A width W3 of the upper plate 31 of the cover 8 is greater than a width or height the front plate 32, the back plate 33, the right and left plates 34 and 35. A lower periphery 32*a* of the front plate 32 of the cover 8 is formed into an arc shape along the upper periphery 3*a* of the front plate 3 of the case main body 7. As shown in FIG. 7 and discussed above, the projecting portion 32*c* is formed at a front surface of a lower periphery of the cover 8 so that when the cover 3 is put in the closed condition, the projecting portion 32*c* of the cover 8 is engaged with the projecting portion 3*c* of the front plate 3.

As shown in FIG. 2, the locked portion 36 is provided at a center portion of the arc-shaped lower periphery 32 of the front plate 32 of the cover 8. When the cover 8 is put in the closed condition, the locked portion 36 is engaged with the cover lock portion 24 of the case main body 7 and therefore the cover 8 is locked. Further, as shown in FIG. 2, a pair of overlap portions 37 and 38 are formed at back and lower end portions of the respective right and left plates 34 and 35 of the cover 8, respectively. The overlap portions 37 and 38 are overlapped with outer surfaces of the right and left plate 5 and 6 of the case main body 7, respectively. The rotation shafts 11 of the rotating means 9 are formed at the opposite inner surfaces of the overlap portions 37 and 38, respectively. By setting the overlap portions 37 and 38 of the cover 8 so as to clump the right and left plates 5 and 6 of the case main body 7 and by engaging the rotation shafts 11 of the overlap portions 37 and 38 with the elongate bearing portions 12 of the right and left plates 5 and 6 of the case main body 7, the cover 8 is assembled with the case main body 7 so as to be swingably opened and closed relative to the case main body 7 and to be movable in the vertical direction of the case main body 7.

Figure 9:
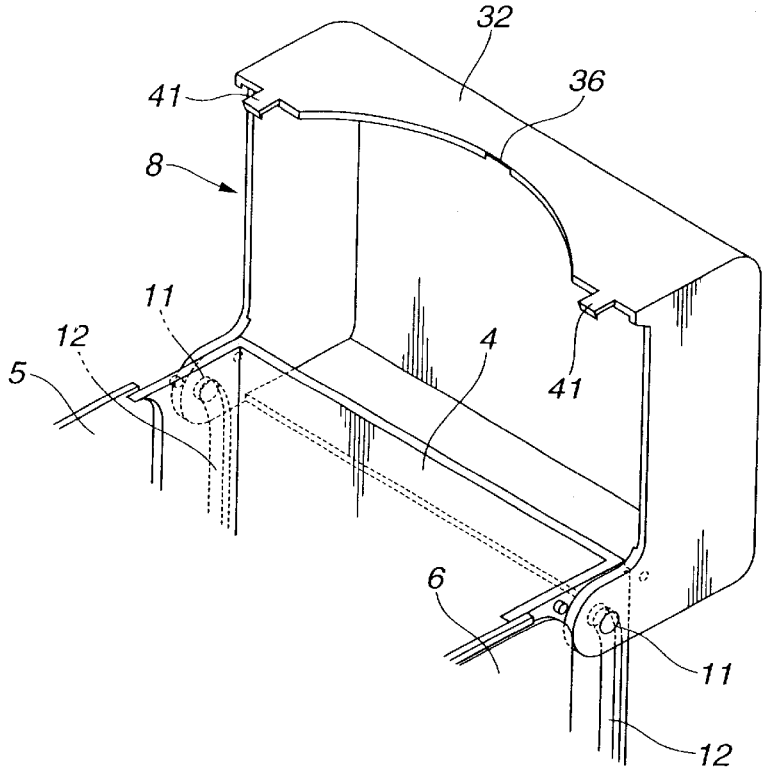
FIG. 9 is a perspective view showing a modification of the storage case of the embodiment according to the present invention.
Figure 10:
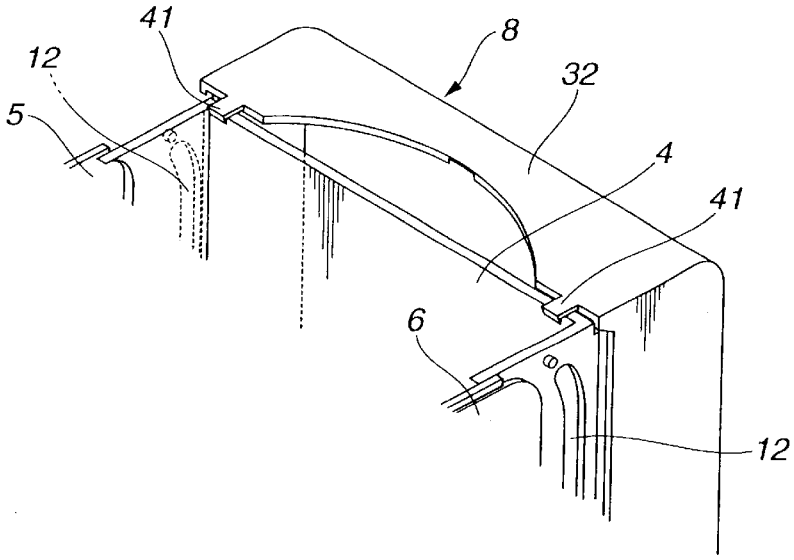
FIG. 10 is a perspective view showing a modification of the storage case of the embodiment according to the present invention.

As a modification of the lock structure, a pair of connecting portions 41 and 41 may be provided at both lateral sides of the lower end of the front plate 32 of the cover 8 as shown in FIG. 9. Further, the pair of the connecting portions 41 and 41 may be hung on an upper end of the back plate 4 of the case main body 7 as shown in FIG. 10 when the cover 8 is opened and slid down along the back plate 4 of the case main body 7. This hook structure functions to prevent the cover 9 from freely rotating and to support the cover 8.

Figure 11:
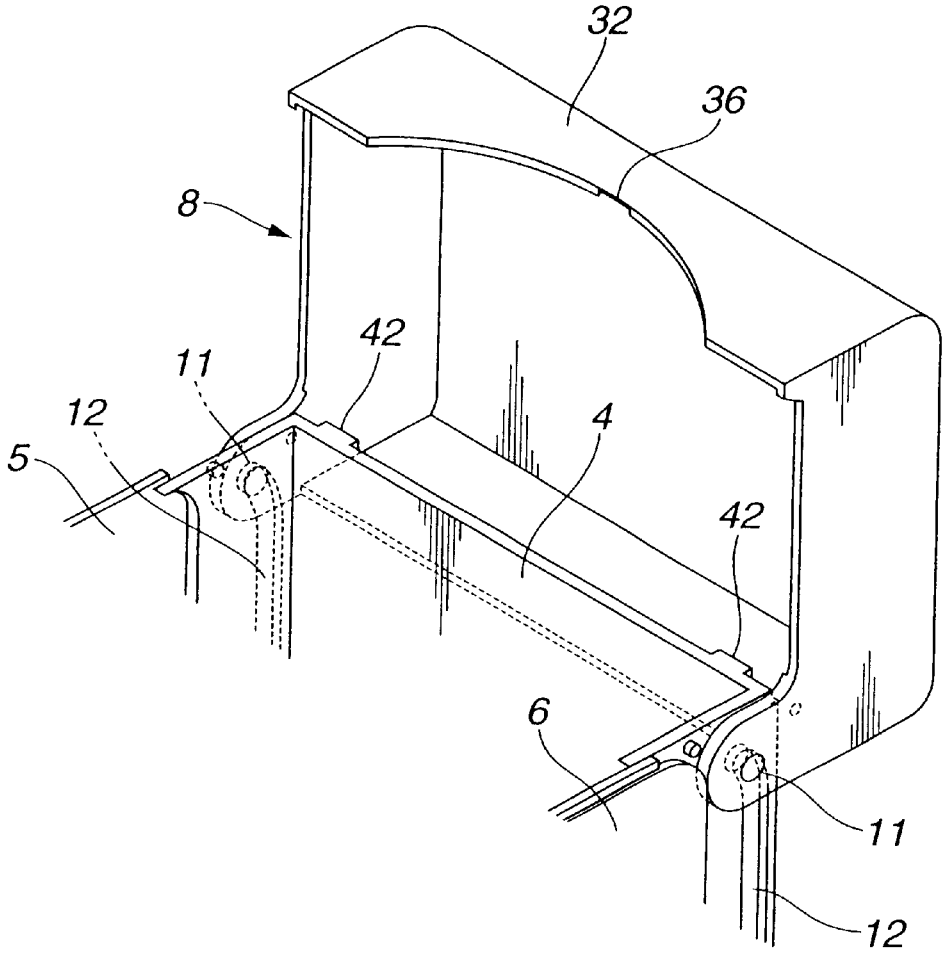
FIG. 11 is a perspective view showing a modification of the storage case of the embodiment according to the present invention.

As a modification of the above hoo structure, a pair of ribs 42 and 42 may be formed at both lateral sides of the upper end of the back plate 4 as shown in FIG. 11. The provision of the ribs 42 and 42 enables the cover 8 to be slid down along the back plate 4 without directly contacting with the back plate 4 and to be hung on the ribs 42 and 42 when the cover 8 is opened and put in the slid down state.

Figure 12:
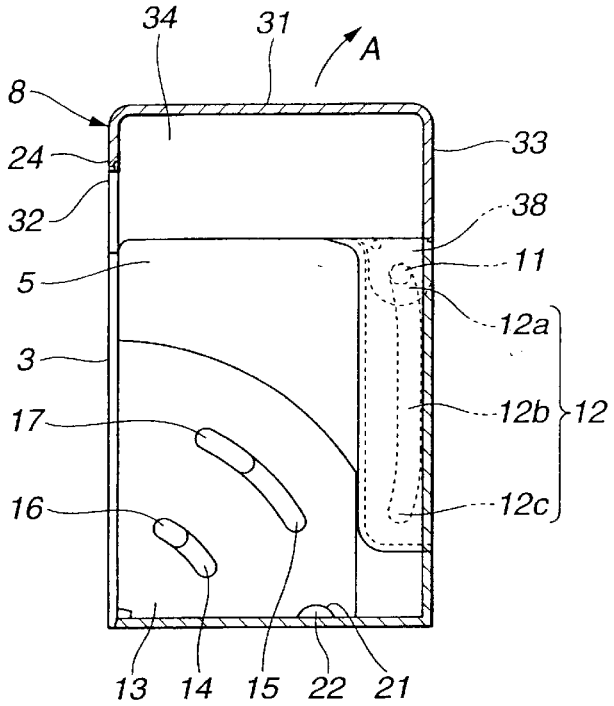
FIG. 12 is a cross sectional view showing the storage case put in a cover closed condition.

Next, the manner of operation of the storage case 1 will be discussed. As shown in FIG. 12, when the cover 8 is put in the closed condition, the cover 8 is overlapped with the upper end of the case main body 7 and locked through the cover lock portion 24 of the case main body 7. Further, in this closed condition, the rotation shafts 11 are supported at the first groove portions 12*a*.

Figure 13:
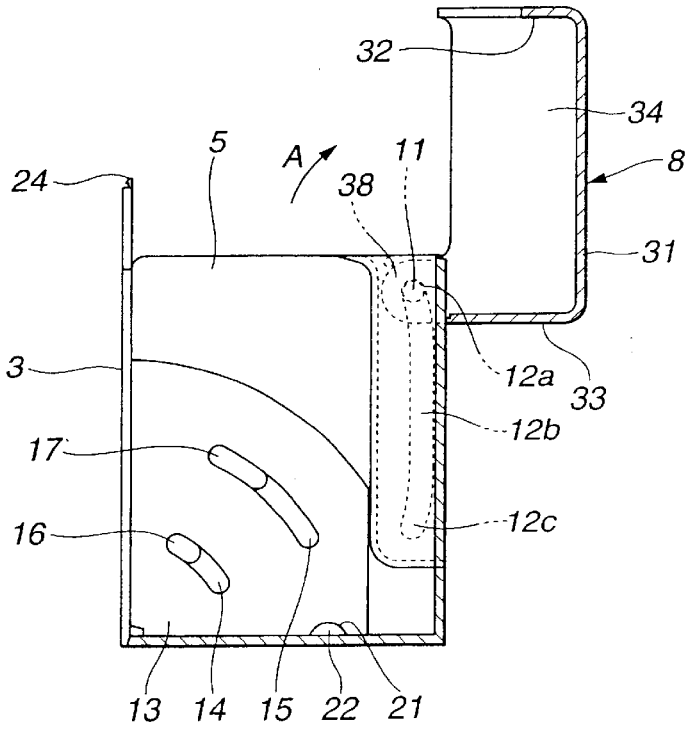
FIG. 13 is a cross sectional view showing the storage case put in a cover opened condition.

By rotating the cover 8 by 90° toward the direction of the arrow A of FIG. 12 from the closed condition, the cover 8 is put in the upright state as shown in FIG. 13.

Figure 14:
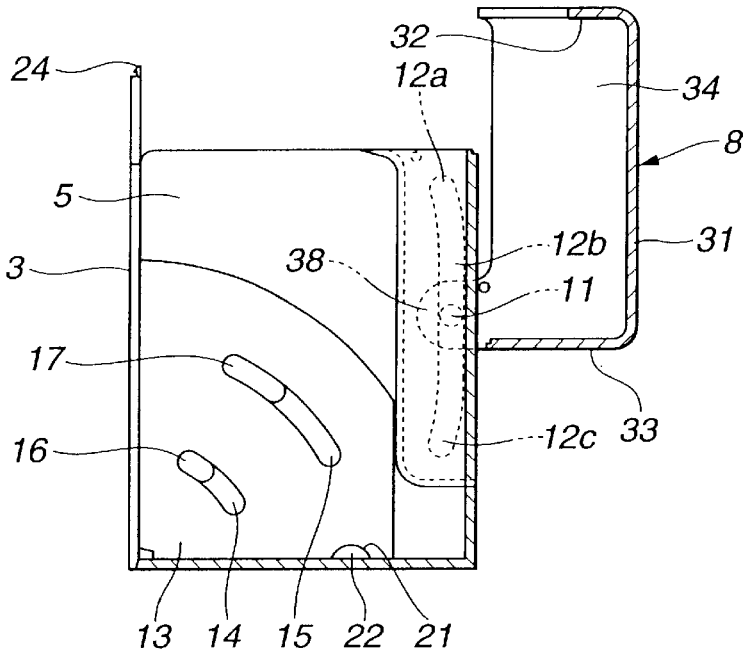
FIG. 14 is a cross sectional view showing the storage case whose cover is now slid down along a back plate.

By sliding down the cover 8 from the upright state of FIG. 13, the rotation shafts 11 are moved from the first groove portions 12*a* to the second groove portions 12*b*, and the cover 8 is slid down along the back plate 4 while being slightly apart from the back plate 4, as shown in FIG. 14.

When the rotation shafts 11 reach the lower ends of the second groove portions 12*b*, the rotation shafts 11 are moved to the third groove portions 12*c*, the cover 8 approaches the back plate 4 of the case main body 7 as compared with the condition at the second groove portions 12*b*.

Figure 15:
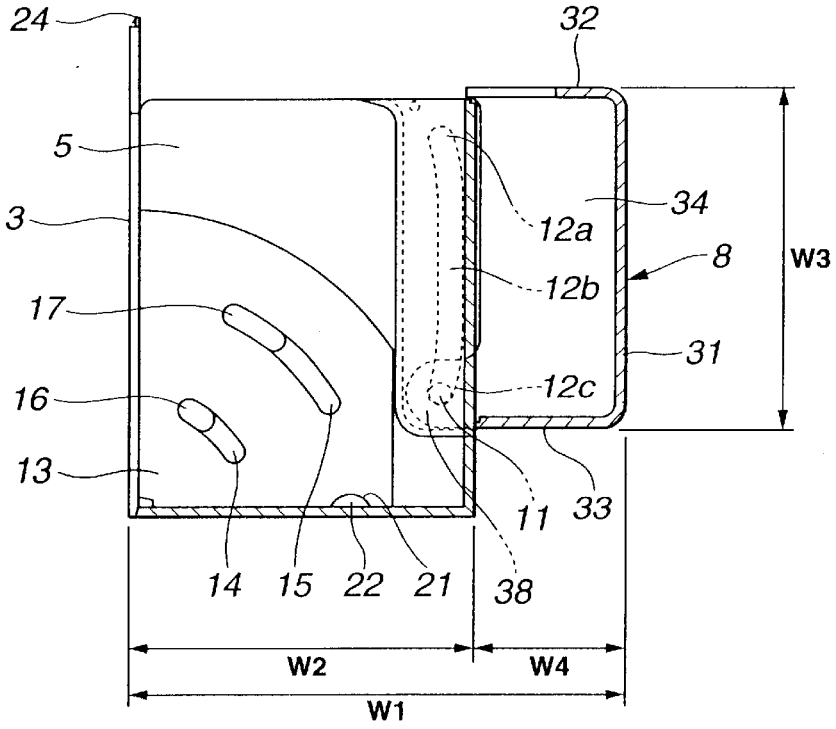
FIG. 15 is a cross sectional view showing the storage case whose cover has been slid down along a back plate.
Figure 16:
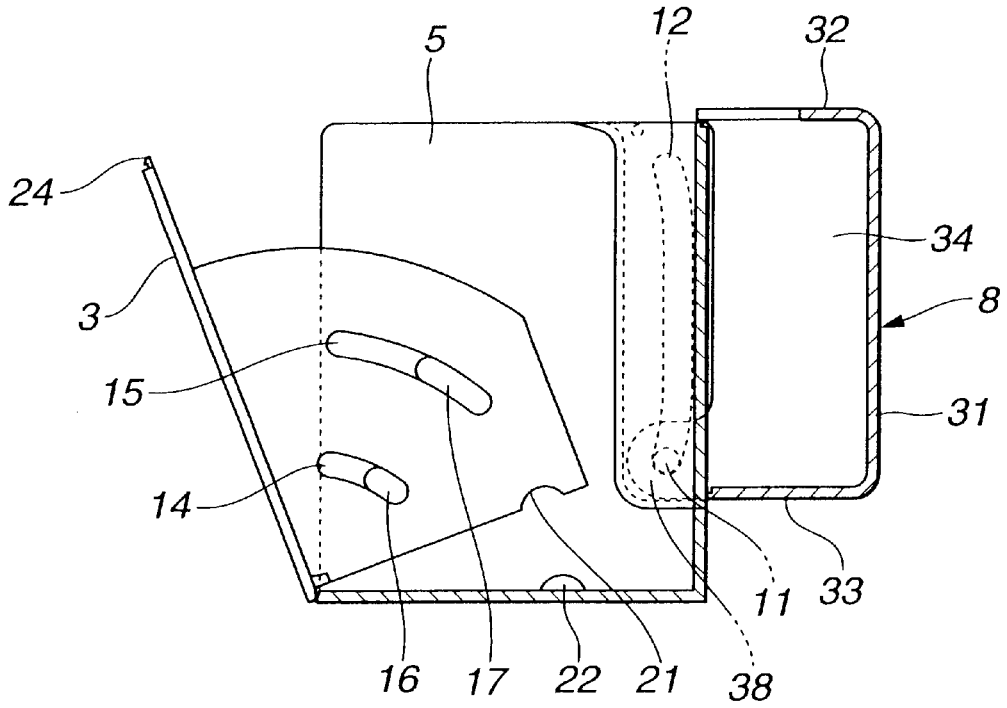
FIG. 16 is a cross sectional view showing the storage case put in a condition that a front plate of a case main body is tilted forward.
Figure 20:
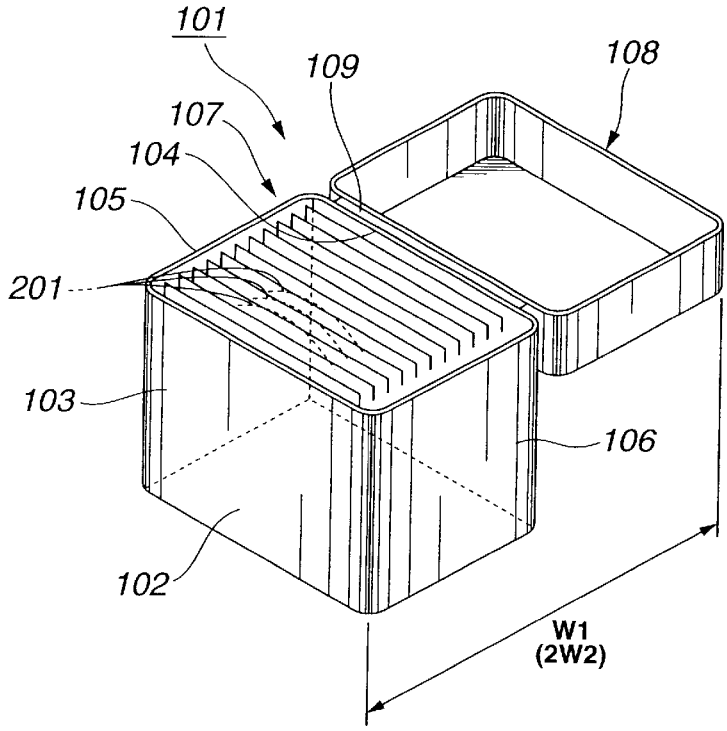
FIG.20 (PRIOR ART)
FIG. 20 is a perspective view showing the conventional storage case in the cover opened condition.
Figure 21:
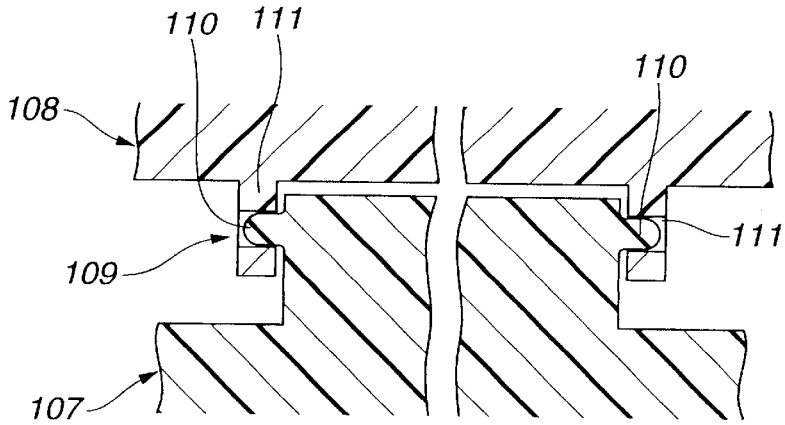
FIG.21 (PRIOR ART)
FIG. 21 is a cross sectional view showing a rotating means of a conventional storage case.

When the cover 8 is put in the slid-down condition as shown in FIG. 15, a total width W1 of the storage case 1 becomes generally equal to the sum of the width W2 of the case main body and the width W4 of the front plate 32 of the cover 8 ($W1 \approx W2+W4$). Since the width W4 is smaller than the depth W3 ($W4<W3$), the total width W1 of the storage case 1 in the opened condition shown in FIG. 15 becomes smaller than that of a convention storage in the opened condition shown in FIG. 20. Therefore, it becomes possible to decrease the size of the storage case 1 in the opened condition. Further, by tilting the front plate 3 forward as shown in FIG. 16, the discs in the storage case 1 are easily taken out from the storage case 1.

Figure 17:
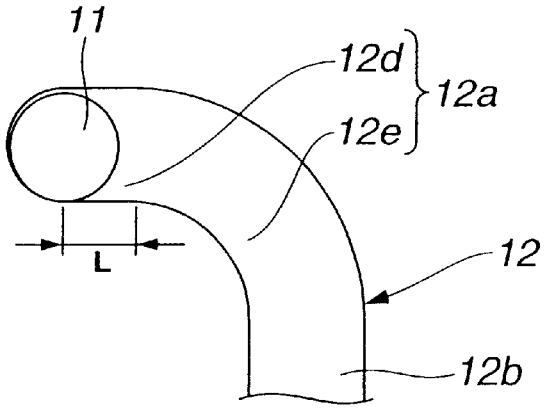
FIG. 17 is a plan view showing a modification of the bearing portion of the storage case according to the present invention.
Figure 18:
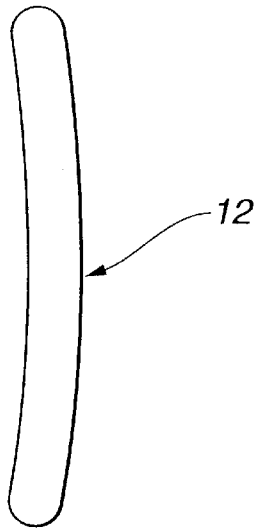
FIG. 18 is a plan view showing another modification of the bearing portion of the storage case according to the present invention.
Figure 19:
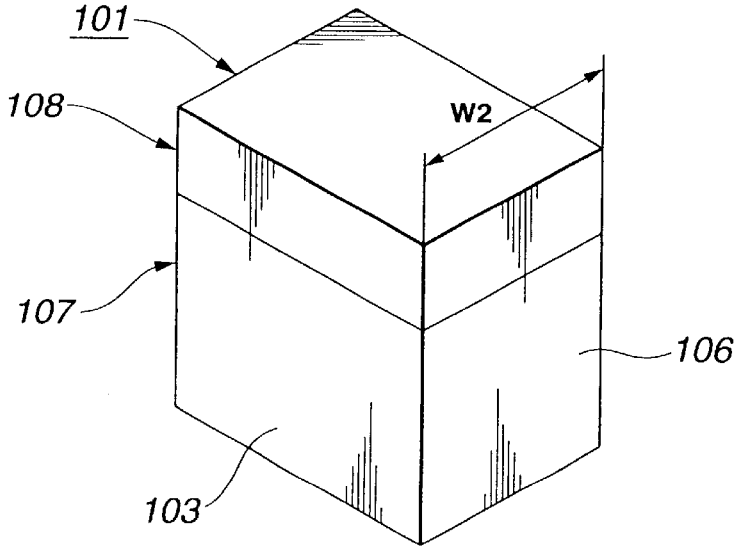
FIG.19 (PRIOR ART)
FIG. 19 is a perspective view showing a conventional storage case put in the cover closed condition.

Additionally, each first groove portion 12*a* may be constituted by a horizontal groove portion 12*d* and an arc shaped groove portion 12*e* as shown in FIG. 17. By this modification, it becomes possible to further firmly support the rotation shafts 11. Further, a length L of the horizontal groove portion 12*d* may be set at about one-fourth of a circumferential dimension of the rotation shaft 11. With this modification, by rotating the cover 8 by 90° from the condition of FIG. 16, the rotation shaft 11 is rotated by one-fourth of the circumferential dimension of the rotation shaft 11 and moves from the horizontal groove portion 12*d* to the arc shaped groove portion 12*e*. Then the rotation shaft 11 smoothly moves to the second groove portion 12*b*.

With the thus arranged storage case 1 according to the present invention, the following advantages are ensured.

Since the storage case 1 according to the present invention is arranged to slide down the cover 8 after the cover 8 is opened at the upright state, a center of gravity of the storage case 1 is lowered in height so as to be further stable. Further it is possible to decrease the total width of the storage case 1 in the opened condition at the sum of the width of the case main body 7 and the width (height of the cover 8) of the front plate 32 of the cover 8.

The storage case 1 is arranged such that the rotation shafts 11 are supported to the first groove portions 12*a* when the cover 8 is put in the closed condition. Further when the cover 8 is vertically slid down in the upright state, the cover 8 is slight apart from the case main body 7 due to the arrangement of the second groove portions 12*b*. Therefore, it becomes possible to slide down the cover 8 without interfering (contacting) the case main body 7. Furthermore, the third groove portions 12*c* are arranged so that the cover 8 approaches the case main body 7 when the cover 8 is slid down to the predetermined lower position. This arrangement enables the total width of the storage case 1 in the opened condition to be further decreased.

Since the front plate 3 of the case main body 7 is arranged to tilt forward, it becomes possible to further easily take out discs from the storage case 1.

As compared with a conventional storage case arranged such that a front plate is tilted by rotation shafts providing at lower end of the front plate, the storage case 1 according to the present invention is arranged simple in the tilt mechanism of the front plate 3 and enables the front plate 3 to be easily and firmly tilted at a desired angle.

Since the storage case 1 is arranged such that the curvatures of the first and second tilt shafts 16 and 17 are generally the same as those of the first and second tilt guide grooves 14 and 15, it becomes possible to smoothly tilt the front plate 3 without generating backlash of the first and second tilt shafts 16 and 17 in the first and second guide grooves 14 and 15.

Since the storage case 1 according to the present invention comprises the depressed portions 21 and the projecting portions 22, the position of the front plate 3 is firmly and correctly determined by the engagement between the depressed portions 21 and the projecting portions 22 when the front plate 3 is returned from the tilted state to the upright state.

Even when a clearance is generated between the lower end of the front plate 3 and the front end of the bottom plate 2 of the case main body 7 by tilting the front plate 3 forward, an upper side of the clearance is covered with the rib 23 formed at the lower end of the front plate 3 of the storage case according to the present invention. Therefore, it becomes possible to prevent discs stored from sliding into the clearance.

Further, since the upper end of the front plate 3 is formed into an arc shape and the lower end of the cover 8 is formed into an arc shape corresponding to the arc shape of the front plate 3, the lower end of the cover 8 is engaged with the upper end of the front plate by closing the cover 8, and the cover 8 is automatically adjusted at the position along the lateral direction. Further, the locking means locks the cover 8 with the case main body 7 and prevents the front plate 3 from being tilted forward in the cover closed condition. Further, since the lock means is located at the upper side of the stored discs, the lock means does not injure discs.

With the above-mentioned arrangements according to the present invention, the cover 8 is slid down along the back surface of the case main body 7 after opened to the upright state. Therefore the gravity point of the storage case 1 is lowered in height and the storage case 1 is put in stable state. Further it becomes possible to decrease the width of the storage case 1 in the cover opened condition to the sum of the width of the case main body 7 and the width of the front plate of the cover 8 (a height of the cover 8).

Further it becomes possible to arrange such that the rotation shaft 11 is supported to the first groove portion 12*a* when the cover 8 is closed, the cover 8 is released from the case main body 7 so that the cover 8 does not interfere with the case main body 7. When the cover 8 is slid down at a predetermined position by the third groove portion 12*c*, the cover 8 approaches the case main body 7. Therefore, the width of the storage case 1 in the cover opened condition is further decreased.

The storage case 1 according to the present invention is arranged to tilt the front plate 3 of the case main body 7 forward. This arrangement enables discs to be easily taken out for the storage case 1.

The storage case 1 according to the present invention is arranged to firmly and easily tilt the front plate 3 at a desired angle as compared with a conventional case arranged such that a lower end of a front plate is rotatably installed to a case main body.

Since the storage case 1 according to the present invention is arranged such that the curvatures of the tilt shafts 16 and 17 are generally the same as the curvatures of the tilt guide grooves 14 and 15, the tilt shafts 16 and 17 smoothly move in the tilt guide grooves 14 and 15 without generating backlash.

By the provision of the depressed portions 22 and the projecting portions 21, the front plate 3 is correctly set at a predetermined position when the front plate 3 is returned from the tilted state to the upright state.

The storage case 1 according to the present invention is arranged such that the rib 23 is provided at the lower and inner portion of the front plate 3. Accordingly, even when the clearance is generated between the lower end of the front plate 3 and the front end of the bottom plate 2 by tilting the front plate 3, the rib 23 covers the clearance and prevents the discs from sliding in the clearance.

Since the upper end of the front plate 3 is formed into an arc shape and the front plate 3 of the cover 8 is formed corresponding to the arc shape of the front plate 3, the upper end of the front plate 3 is correctly engaged with the lower end of the cover 8 when the cover 8 is put in the closed condition. By means of the locking means, the cover 8 is locked with the case main body 7 and the front plate 3 of the case main body 7 is prevented from tilting forward. Further, since the locking means is disposed at the position higher that the upper end of the discs in the storage case 1, the discs are safely stored in the storage case 1 without being insured by the locking means.

This application is based on a prior Japanese Patent Application No. 2000-258459 filed on Aug. 29, 2000 in Japan. The entire contents of this Japanese Patent Application are hereby incorporated by reference.

Although the invention has been described above by reference to a certain embodiment of the invention, the invention is not limited to the embodiments described above. Modifications and variations of the embodiment described above will occur to those skilled in the art, in light of the above teaching. The scope of the invention is defined with reference to the following claims.

What is claimed is:

1. A storage case comprising:

a case main body comprising a bottom plate, a front plate, a back plate, a right plate and a left plate, four sides of the bottom plate being surrounded by the front, back, right and left plates, the case main body having an opening opposite to the bottom plate;

a cover installed to the case main body so as to open and close the opening of the case main body; and a rotating means for installing the cover rotatably to the case main body, the rotating means comprising a rotation shaft installed to the cover and a bearing portion installed to the case main body, the bearing portion supporting the rotation shaft, the bearing portion being formed into an elongate groove extending in a vertical direction of the case main body, wherein the bearing portion comprises a first groove portion, a second groove portion continuous to the first groove portion and a third groove portion continuous to the second groove portion, and wherein the second groove portion is formed straight and the first and third groove portions have an arc shape which is generally symmetrical to each other.

2. The storage case as claimed in claim 1 wherein the first groove portion supports the rotation shaft when the cover is closing the opening of the case main body, the second groove portion supports the rotation shaft so that the cover is moved upward and downward while keeping a distance to the case main body, and the third groove portion movably supports the rotation shaft so that the cover is approached to the case main body.

3. The storage case as claimed in claim 1, further comprising a tilt means for tilting the front plate in a direction that the opening of the case main body is increased.

4. The storage case as claimed in claim 3, wherein the tilt means comprises an overlap plate overlapped with one of the right and left plates of the case main body, first and second guide grooves provided to the overlap plate, and first and second tilt shafts installed to the one of the right and left plates and inserted to the first and second guide grooves, respectively, the first and second guide grooves being formed into arc shapes which are coaxial and the same in angle of the arc but different in diameter.

5. The storage case as claimed in claim 4, wherein the first and second tilt shafts are formed into arc shapes which have curvatures generally the same as curvatures of the first and second guide grooves, respectively.

6. The storage case as claimed in claim 4, wherein a depressed portion is formed at a lower portion of the overlap plate and a projecting portion is formed at an upper surface of the bottom plate so that the depressed portion and the projecting portion are engaged when the front plate is returned from a tilted position to an upright position.

7. The storage case as claimed in claim 3, wherein a rib is formed at a lower end of the front plate to cover a clearance formed between the front plate and the bottom plate when the front plate is put in a tilted state.

8. The storage case as claimed in claim 1, further comprising a lock means for locking the cover with the case main body when the cover is closed, an upper end of the front plate being formed into arc shape, the lock means being installed to a center portion of the arc-shaped upper end of the front plate, the lock means being located at a position higher in height level than an objected stored in the storage case.

9. The storage case as claimed in claim 2, further comprising a lock means for locking the cover with the case main body when the cover is closed, the lock means comprising a pair of hook portions installed to both sides of a lower end of the cover, the hook portions being hung on an upper periphery of the back plate when the rotation shaft is in the third groove portion.

10. A storage case comprising:

a case main body comprising a bottom plate, a front plate, a back plate, a right plate and a left plate, four sides of the bottom plate being surrounded by the front, back, right and left plates, the case main body having an opening opposite to the bottom plate;

a cover installed to the case main body so as to open and close the opening of the case main body;

a pair of rotation shafts integral with the cover; and a pair of bearing portions formed into an elongate groove at the right and left plates, respectively and extending from positions near the opening to a position near the bottom plate, respectively, the bearing portion supporting the rotation shaft, and wherein the bearing portion comprises a first groove portion, a second groove portion continuous to the first groove portion and a third groove portion continuous to the second groove portion, and wherein the second groove portion is straight and the first and third groove portions have an arc shape which is generally symmetrical to each other.

11. The storage case as claimed in claim 10, further comprising first and second tilt shafts installed to at least one of inside surfaces of the right and left plates and first and second tilt grooves formed at a overlap plate integral with the front plate, the first and second tilt shafts being engaged with the first and second tilt grooves, respectively so that the front plate is tilted forward on a lower end periphery of the front plate.

12. A storage case comprising:

a case main body comprising a bottom plate, a front plate, a back plate, a right plate and a left plate, four sides of the bottom plate being surrounded by the front, back, right and left plates, the case main body having an opening opposite to the bottom plate;

a cover installed to the case main body so as to open and close the opening of the case main body;

a rotating means for installing the cover rotatably to the case main body, the rotating means comprising a rotation shaft installed to the cover and a bearing portion installed to the case main body, the bearing portion supporting the rotation shaft, the bearing portion being formed into an elongate groove extending in a vertical direction of the case main body, a tilt means for tilting the front plate in a direction that the opening of the case main body is increased, said tilt means comprising an overlap plate overlapped with one of the right and left plates of the case main body, first and second guide grooves provided to the overlap plate, and first and second tilt shafts installed to the one of the right and left plates and inserted to the first and second guide grooves, respectively, the first and second guide grooves being formed into arc shapes which are coaxial and the same in angle of the arc but different in diameter, and wherein the first and second tilt shafts are formed into arc shapes which have curvatures generally the same as curvatures of the first and second guide grooves, respectively.

13. A storage device comprising:

a case main body comprising a bottom plate, a front plate, a back plate, a right plate and a left plate, four sides of the bottom plate being surrounded by the front, back, right and left plates, the case main body having an opening opposite to the bottom plate;

a cover installed to the case main body so as to open and close the opening of the case main body;

a rotating means for installing the cover rotatably to the case main body, the rotating means comprising a rotation shaft installed to the cover and a bearing portion installed to the case main body, the bearing portion supporting the rotation shaft, the bearing portion being formed into an elongate groove extending in a vertical direction of the case main body, a tilt means for tilting the front plate in a direction that the opening of the case main body is increased, said tilt means comprises an overlap plate overlapped with one of the right and left plates of the case main body, first and second guide grooves provided to the overlap plate, and first and second tilt shafts installed to the one of the right and left plates and inserted to the first and second guide grooves, respectively, the first and second guide grooves being formed into arc shapes which are coaxial and the same in angle of the arc but different in diameter, and wherein a depressed portion is formed at a lower portion of the overlap plate and a projecting portion is formed at an upper surface of the bottom plate so that the depressed portion and the projecting portion are engaged when the front plate is returned from a tilted position to an upright position.

14. A storage device comprising:

a case main body comprising a bottom plate, a front plate, a back plate, a right plate and a left plate, four sides of the bottom plate being surrounded by the front, back, right and left plates, the case main body having an opening opposite to the bottom plate;

a cover installed to the case main body so as to open and close the opening of the case main body;

a rotating means for installing the cover rotatably to the case main body, the rotating means comprising a rotation shaft installed to the cover and a bearing portion installed to the case main body, the bearing portion supporting the rotation shaft, the bearing portion being formed into an elongate groove extending in a vertical direction of the case main body, and a lock means for locking the cover with the case main body when the cover is closed, an upper end of the front plate being formed into arc shape, the lock means being installed to a center portion of the arc-shaped upper end of the front plate, the lock means being located at a position higher in height level than an object stored in the storage case.

15. A storage device comprising:

a case main body comprising a bottom plate, a front plate, a back plate, a right plate and a left plate, four sides of the bottom plate being surrounded by the front, back, right and left plates, the case main body having an opening opposite to the bottom plate;

a cover installed to the case main body so as to open and close the opening of the case main body;

a rotating means for installing the cover rotatably to the case main body, the rotating means comprising a rotation shaft installed to the cover and a bearing portion installed to the case main body, the bearing portion supporting the rotation shaft, the bearing portion being formed into an elongate groove extending in a vertical direction of the case main body, the bearing portion comprises a first groove portion, a second groove portion continuous to the first groove portion and a third groove portion continuous to the second groove portion, the first groove portion supporting the rotation shaft when the cover is closing the opening of the case main body, the second groove portion supporting the rotation shaft so that the cover is moved upward and downward while keeping a distance to the case main body, the third groove portion movably supporting the rotation shaft so that the cover is approached to the case main body, and a lock means for locking the cover with the case main body when the cover is closed, the lock means comprising a pair of hook portions installed to both sides of a lower end of the cover, the hook portions being hung on an upper periphery of the back plate when the rotation shaft is in the third groove portion.

* * * * *